United States Patent [19]

Magnuson

[11] Patent Number: 4,494,441

[45] Date of Patent: Jan. 22, 1985

[54] AMMUNITION FEED TRUNNION SUPPORT

[75] Inventor: Roland A. Magnuson, King, Wash.

[73] Assignee: The United States of America as represented by the Secretary of the Army, Washington, D.C.

[21] Appl. No.: 521,470

[22] Filed: Aug. 8, 1983

[51] Int. Cl.[3] ..... F41H 7/06

[52] U.S. Cl. ..... 89/38; 89/46; 89/9

[58] Field of Search ..... 42/9; 89/1.805, 5, 9, 89/13.05, 13.1, 17, 33.03, 33 MC, 38, 39, 46, 47

[56] References Cited

U.S. PATENT DOCUMENTS

| | | | |
|---|---|---|---|
| 903,324 | 11/1908 | Schneider | 89/38 |
| 1,322,124 | 11/1919 | Lawrence | 89/38 |
| 3,401,598 | 9/1968 | Sons | 89/38 |
| 4,054,080 | 10/1977 | Rossel et al. | 89/38 |
| 4,065,999 | 1/1978 | Hultgren et al. | 89/38 |
| 4,326,446 | 4/1982 | Magnusson | 89/38 |
| 4,329,909 | 5/1982 | Tidstrom | 89/46 |
| 4,442,753 | 4/1984 | Pouri et al. | 89/46 |

*Primary Examiner*—Stephen C. Bentley

*Attorney, Agent, or Firm*—Peter A. Taucher; John E. McRae; Robert P. Gibson

[57] ABSTRACT

Disclosed is a cannon-support mechanism that includes means for loading rounds of ammunition into the firing chamber of the cannon. An upright hollow strut or arm has a swingable connection with a rotary firing chamber mechanism such that individual rounds of ammunition can be transferred from a support vehicle directly through the hollow strut into the cannon firing chamber. The hollow strut is raisable or lowerable in the direction of its length, whereby the ammunition transfer function can be carried out with the cannon in a range of different elevations relative to the roof area of the vehicle.

7 Claims, 3 Drawing Figures

AMMUNITION FEED TRUNNION SUPPORT

GOVERNMENT INTEREST

The invention described herein may be manufactured, used, and licensed by or for the Government for governmental purposes without payment to me of any royalty thereon.

BACKGROUND AND SUMMARY

This invention relates to a military land vehicle having improved means for bodily moving an external cannon from a lowered prone position near the roof area of a vehicle turret to an elevated prone position remote from the turret roof area. The cannon support means comprises an upright hollow tube that serves as a conveyor means for delivering individual rounds of ammunition from the turret interior to the cannon firing chamber.

With the cannon in its elevated position the vehicle can be located in a trench or behind a hill or wall in a partially-concealed condition; the elevated cannon can be fired at air targets or ground targets beyond the hill or wall without fully exposing the vehicle to enemy observation. The cannon is lowered when it is desired to move the vehicle over flat terrain not conducive to concealment of the vehicle from enemy observation. The lowered cannon somewhat minimizes the vehicle silhouette, thereby reducing the possibilities for early detection by the enemy, and/or destruction by enemy fire.

It is already known to provide military land vehicles with elevatable cannons. See for example my issued U.S. Pat. No. 4,326,446, as well as U.S. Pat. No. 3,401,598 issued to C. C. Sons Jr., and U.S. Pat. No. 4,065,999 issued to K. S. R. Hultgren. The principle feature of the present invention is the incorporation of an ammunition loading capability into the cannon support structure. The loading system is designed to be operational with the cannon in its elevated or lowered position.

THE DRAWINGS

Figure 1:
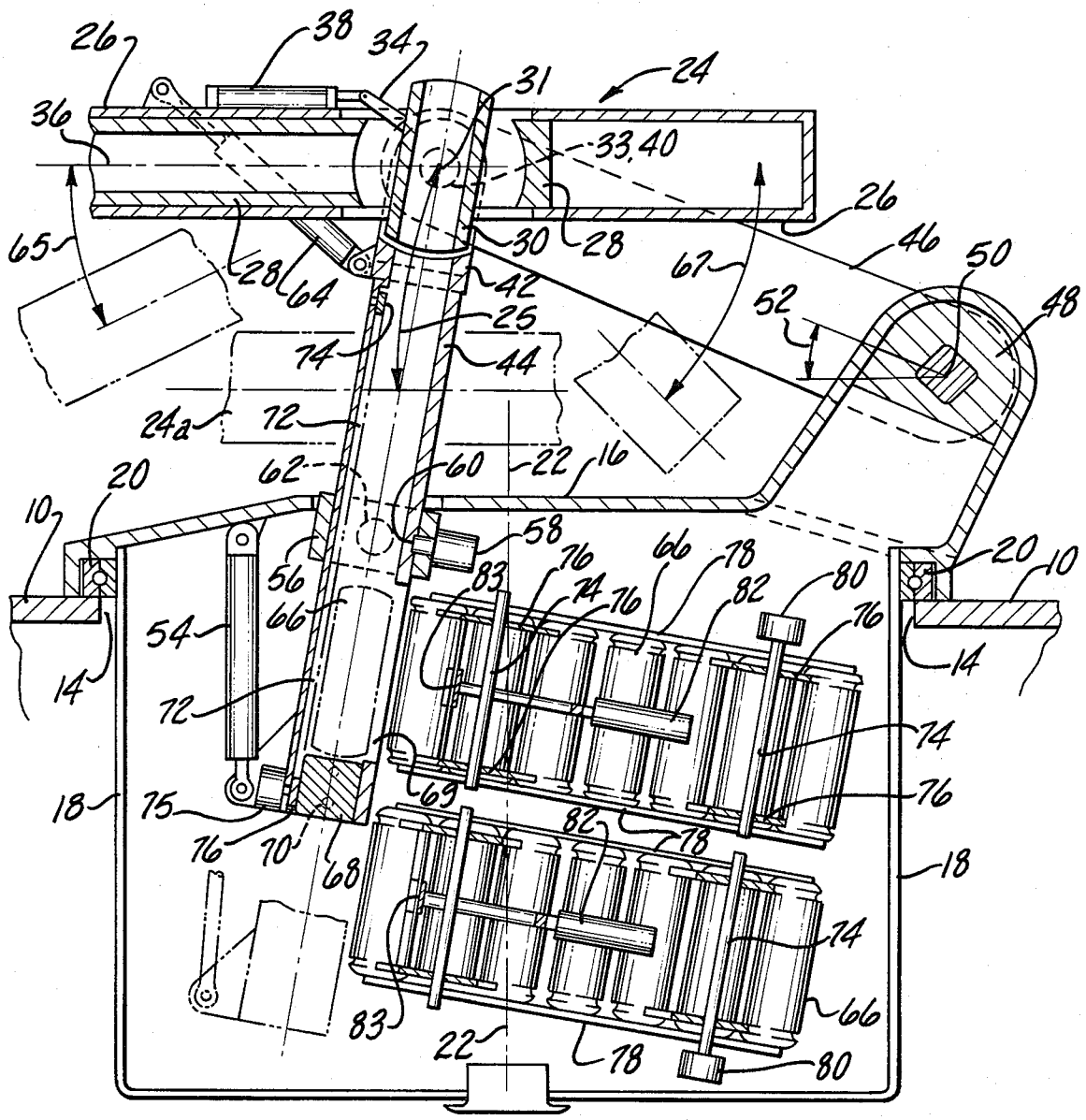
FIG. 1 is a fragmentary sectional view taken through a vehicle incorporating my invention.

Referring in greater detail to the drawing, there is shown a military land vehicle (tank) comprising a hull having an upper wall 10. A circular opening 14 in wall 10 accommodates a rotary turret structure that includes a turret roof 16 and depending basket 18. An annular anti-friction bearing 20 supports the turret for rotational azimuthal movement around central axis 22.

Figure 2:
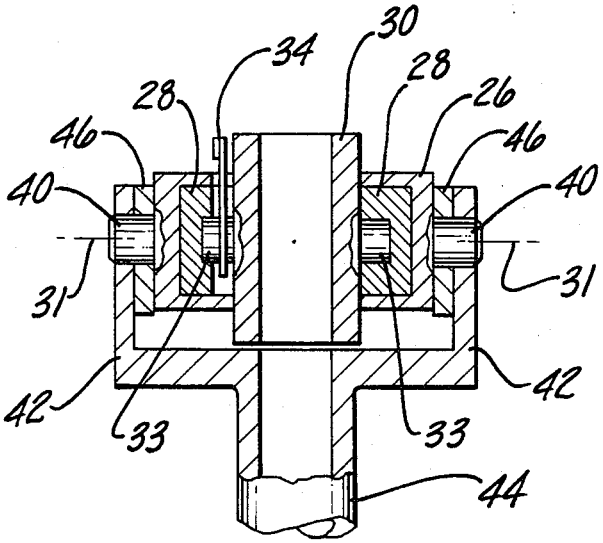
FIGS. 2 and 3 are fragmentary views illustrating structural details used in the FIG. 1 construction.

Located above the turret is an external gun or cannon 24 of conventional design, e.g. a 75 mm cannon developed by Ares Inc. of Port Clinton, Ohio. As schematically shown in the drawing, the cannon comprises a receiver 26 and breech 28 slidable therein. The firing chamber is defined by a tubular member 30 swingably disposed within a cavity in breech 28 for arcuate motion around a transverse axis 31; as shown in FIG. 2, pivot pins 33 extend from member 30 into circular openings in breech 28 to define the swing axis. A fluid cylinder 38 and linkage 34 may be provided to swing member 30 between the illustrated ammunition-load position and a non-illustrated firing position aligned with the cannon bore axis 36.

Receiver 26 has trunnion pins 40 extending transversely into a yoke structure 42 suitably formed on or affixed to the upper end of a hollow tube 44. Trunnion pins 40 are coincident with the above-mentioned pivot pins 33, i.e. on transverse axis 31. Trunnion pins 40 extend through circular openings in two spaced parallel arms or links 46. As seen in FIG. 1, links 46 extend generally downwardly and rightwardly from yoke structure 42 into overlapment with an upstanding bracket structure 48 affixed or formed on turret roof 16. Hinge connections 50 between the spaced links and bracket structure 48 permit the links to swing in vertical arcs around the hinge 50 axis, as designated by numeral 52 in FIG. 1. Hinge connections 50 can include a torsion bar or torsion spring coiled on the hinge axis for exerting clockwise (upward) forces on links 46, sufficient to fully or partially absorb the weight of cannon 24. Links 46 and yoke structure 42 are independently rotatable around trunnion pins 40 so that links 46 and the tube 44-yoke structure 42 can move in diverse directions without mechanical interference.

Cannon 24 is supported above the turret by a support arm mechanism that comprises the upwardly-angled arms or links 46 and the generally upright support tube 44. The support tube can be moved in the direction of its length to enable links 46 to swing in counterclockwise arcs about hinge axis 50, thus causing the cannon to move bodily from its illustrated position elevated above the turret to a lowered position **24*a* near the turret roof. Depending on the control system used, various intermediate positions of the cannon are possible. Arc 25 designates the paths taken by pivots 33 and 40 during movement of the cannon between its fully raised and fully lowered positions. FIG. 1 shows in dashed lines the lower end of tube 44 when the cannon is in its lowered position. Arc 52 designates the swing limits of links 46 during movement of the cannon between its raised and lowered positions; in the illustrated system arc 52 measures about twenty-five degrees. When the cannon is in its lowered prone position, links 46 take horizontal positions in close adjacency to roof 16**.

Power for shifting tube 44 upwardly, or downwardly, is provided by a fluid cylinder 54 having its cylinder end and piston rod end pivotably connected, respectively, to the turret roof and tube 44 lower end. A collar 56 slidably encircles the tube at a point near the turret roof, whereby the tube is guided while it is being shifted in the direction of its length. When the cannon is in its elevated position a short-stroke fluid cylinder 58 carried by collar 56 is energized to move a locking pin 60 (or other clamp element) into locking engagement with tube 44. If it is desired to have only a two-elevation system (fully lowered or fully raised) the support tube can have a notch to receive the locking pin; various lock systems are possible. When locked, collar 56 supports the tube-cannon weight, thereby stabilizing the cannon and relieving the load on cylinder 54. As previously, noted, at least some of the cannon weight can also (or alternately) be absorbed by torsion spring hinge 50. Transverse pivot pins 62 extend from collar 56 into a support bracket carried by turret roof 16, for enabling the collar to accommodate slight directional changes of tube 44 while the tube is undergoing its shifting motion.

The cannon can be swingably adjusted in the elevational plane by means of two fluid cylinders 64 having their opposite ends pivotably connected to yoke 42 and receiver 26. The two cylinders 64 (only one of which is visible) may be located alongside the cannon receiver side surfaces. Arcs 65 and 67 designate the cannon elevational angulation adjustments achieved by cylinders 64.

An important feature of my invention is the incorporation into support tube 44 of mechanism for conveying individual rounds of ammunition 66 from the turret interior upwardly into the firing chamber defined by member 30. The conveyor mechanism includes a movable ram member 68 locatable in tube 44 below the plane of a side opening 69 in the tube wall. After a round of ammunition has been introduced through opening 69 into the tube 44 space above member 68 the ram member is driven rapidly upwardly to propel the round into the cannon firing chamber. The spent shell is ejected from the firing chamber by the force of the incoming round. Ram member 68 may be guided by means of rollers 70 travelling in longitudinal grooves in the tube 44 side wall.

Ram member 68 can be moved upwardly in tube 44 by various power devices, e.g. a ball screw. As shown in FIG. 1, the power device comprises an endless chain 72 trained around upper and lower sprockets 74 and 76 in a channel or groove in the tube 44 side wall. A motor 75 drives lower sprocket 76, which drives the chain; ram member 68 has an anchorage connection with one of the chain links, such that chain travel produces upward motion of the ram member in tube 44. Reverse rotation of motor 75 returns the ram member to its starting position.

Live ammunition rounds are stored in magazines within the turret interior. Various magazine structures are possible. For illustration purposes I show two similar magazine systems; an upper magazine for use when the cannon is in its elevated position, and a lower magazine for use when the cannon is in its lowered position (see the dashed line position of the tube 44 lower end). Individual rounds are pushed from the magazine through tube opening 69 to place the round in the path of ram member 68.

Figure 3:
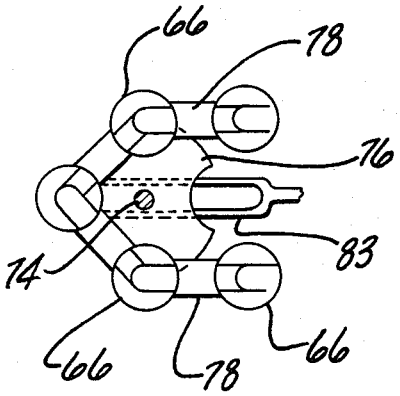

Each magazine can include two upright shafts 74 mounted in suitable non-illustrated bearings. Each shaft carries two sprockets 76 which have circular notches engaged with circular surfaces on individual ammunition rounds. Conventional links 78 connect the rounds into an endless system. A motor 80 indexes one of the shafts 74 to position successive ones of the rounds in alignment with opening 69 in tube 44. At that point a fluid cylinder 82 is energized to cause pusher member 83 to move the aligned round out of the magazine and into the space above ram 68. The pusher member may be slotted, as shown in FIG. 3, to avoid interference with the associated sprocket shaft.

During cannon firing operations the recoil force is absorbed primarily by links 46. Tube 44 acts primarily to stabilize the positions of trunnions 40, and to carry a portion of the cannon static weight (about twenty five hundred pounds in a typical situation). Links 46 are approximately normal to tube 44 and more or less aligned with the cannon bore axis 36 (depending on the elevational angulation of the cannon achieved by cylinder 64). Tube 44 is preferably angled to a vertical reference line (e.g. line 22) at approximately ten degrees. With such an angle the tube experiences only a very slight directional change while it is being shifted in the direction of its length. The tube has the same ten degree angulation when it is at the opposite extremes of its motion limits (when it is positioned to receive rounds from the storage magazines).

The ammunition loading system is usable with external cannons bodily movable between lowered position 24*a* and an elevated position (shown). The ammunition loading operation can be performed with the cannon in either its lowered or elevated position. If the cannon were to be permanently mounted as an elevated structure (i.e. by omitting cylinder 54) only the upper ammunition storage maganize would be used.

I wish it to be understood that I do not desire to be limited to the exact details of construction shown and described for obvious modifications will occur to a person skilled in the art, without departing from the spirit and scope of the appended claims.

I claim:

1. In a military land vehicle comprising a hull; a turret mounted on the hull for rotational motion in the azimuth direction, said turret including a roof located approximately in the plane of the hull upper surface, a cannon located above the turret roof, and a mechanism supporting said cannon for bodily motion between a first lowered prone position adjacent said turret roof, and a second elevated prone position remote from said turret roof; said cannon comprising a receiver, a breech slidable with said receiver, and firing chamber means within said breech: the improvement wherein said support mechanism comprises a hollow elongated upright tube extending within the turret through an opening in said turret roof, a yoke affixed to the upper end of said hollow tube, trunnion means (40) between said yoke and cannon receiver enabling said cannon to swing in an elevational plane around an axis transverse to the longitudinal axis of said hollow tube, bracket means upstanding from said turret roof remote from said hollow tube, link means (46) pivotally connected to said bracket means and to said trunnion means for arcuate swinging motion in a vertical arc during motion of said cannon between its lowered position and its elevated position, said link means being oriented to absorb recoil forces during the cannon firing operation; and means within said hollow tube for conveying individual rounds of ammunition from the turret interior through said tube to said cannon firing chamber.

2. The improvement of claim 1 and further comprising power means within said turret for shifting said hollow tube in the direction of its length to raise or lower the cannon, said power means comprising a fluid cylinder means having one of its ends pivotably connected to said turret roof and having its other end pivotably connected to the lower end of said hollow tube, whereby expansion of said fluid cylinder means lowers said cannon from its elevated position, and contraction of said cylinder means raises said cannon from its prone position.

3. The improvement of claim 1; said support mechanism further comprising a collar suspended from said turret roof for encircling said hollow tube at a point near the underside of said turret roof, said collar being slidably engaged with said hollow tube for guiding same while it is being shifted in the direction of its length; and means enabling said collar to pivot around an axis transverse to the tube axis for accommodating slight directional changes of said hollow tube while it is being shifted.

4. The improvement of claim 3 wherein said support mechanism further comprises means carried by said collar for locking said hollow tube to said collar when said hollow is in its raised position.

5. The improvement of claim 1, wherein said cannon firing chamber means comprises a tubular element swingable on an axis coincident with said trunnion means axis, whereby said firing chamber can be swung to a loading position aligned with said hollow tube.

6. The improvement of claim 1, wherein said hollow tube is angled to a vertical reference line at approximately ten degrees when said tube is in its raised and lowered positions; said link means being swingable through an arc of about twenty-five degrees during movement of said cannon between its lowered and elevated positions.

7. The improvement of claim 6, wherein said link means is oriented horizontally when said cannon is in its lowered prone position.

* * * * *